US006571981B2

(12) United States Patent
Rohlfs

(10) Patent No.: US 6,571,981 B2
(45) Date of Patent: Jun. 3, 2003

(54) DISPOSABLE SIPPER CUPS

(76) Inventor: Joey L Rohlfs, 1319 Owens Ave., Ventura, CA (US) 93004

( * ) Notice: Subject to any disclaimer, the term of this patent is extended or adjusted under 35 U.S.C. 154(b) by 0 days.

(21) Appl. No.: 09/839,322

(22) Filed: Apr. 21, 2001

(65) Prior Publication Data

US 2002/0179614 A1 Dec. 5, 2002

(51) Int. Cl.[7] ..... A47G 19/22
(52) U.S. Cl. ..... 220/713; 220/839; 206/515
(58) Field of Search ..... 220/713, 839, 220/717; 206/515

(56) References Cited

U.S. PATENT DOCUMENTS 3,063,549 A * 11/1962 Weichselbaum
3,841,528 A * 10/1974 Eisenberg
4,687,129 A * 8/1987 Cugley
4,961,510 A * 10/1990 Dvoracek ..... 220/258.2
5,253,781 A * 10/1993 Van Melle et al. ..... 220/380
5,363,983 A * 11/1994 Proshan ..... 220/380
5,366,109 A * 11/1994 Proshan ..... 220/380
5,538,157 A * 7/1996 Proshan ..... 220/711
5,667,094 A * 9/1997 Rapchak et al.
5,979,697 A * 11/1999 Kim ..... 220/713
6,220,476 B1 * 4/2001 Waller ..... 220/713
6,325,236 B1 * 12/2001 Wong ..... 215/11.5

* cited by examiner

*Primary Examiner*—Joseph M. Moy
(74) *Attorney, Agent, or Firm*—Michael I Kroll

(57) ABSTRACT

The present invention 10 is a sipper cup for children composed of a disposable material with a molded hinge 18 that connects the container body 16 and cling lid 14 of the present invention. The hinge 18 serves the user by providing easy opening and closing of the cup 16, for filling or refilling purposes. The cling lid 14 prevents the beverage contained therein from easily spilling and is outfitted with a sipping tip 20 with aperture 26 therein. The cling lid 14 attaches to the container body 16 via a locking flange 22 and locking recessed channel 24 that fit into and mate with one another. The sipping tip 20 minimizes the amount of liquid spilled if spilling conditions such as knocking over or dropping the cup 16 occur, making this device ideal for children. An alternative embodiment discloses a non-slip insulating sleeve 32 for placement round the container body 16.

2 Claims, 12 Drawing Sheets

DISPOSABLE SIPPER CUPS

BACKGROUND OF THE INVENTION

1. Field of the Invention

The present invention relates generally to sipper cups and, more specifically, to a sipper cup for children composed of a disposable material with a molded hinge that connects the container body and cling lid of the present invention. The devices hinge serves the user by providing easy opening and closing of the cup, for filling or refilling purposes. The cling lid prevents the beverage contained from easily spilling and is outfitted with a sipping tip. The cling lid attaches to the container body via a locking flange and locking recessed channel that fit into one another. The sipping tip minimizes the amount of liquid spilled if spilling conditions such as knocking over or dropping the cup are subjected to the device, making this device ideal for children. The device also has a non-slip insulating sleeve that can be placed around the present invention to provide more comfortable holding of the device when a hot beverage is contained. The insulating sleeve may also serve as a medium for attaching the molded hinge to the container body providing the option of removing the cling lid from the device entirely if desired.

2. Description of the Prior Art

There are other sipper cup devices designed for children. Typical of these is U.S. Pat. No. 3,938,695 issued to Stanley Ruff on Feb. 17, 1976.

Another patent was issued to Scott Okerstrum on Oct. 24, 1978 as U.S. Pat. No. 4,121,731. Yet another U.S. Pat. No. 4,158,902 was issued to Milton P. Chernack on Jun. 26, 1979 and still yet another was issued on Nov. 9, 1982 to Sidney M. Libit as U.S. Pat. No. 4,358,032.

Another patent was issued to Robert A. Bennit on Jun. 2, 1987 as U.S. Pat. No. 4,669,622. Yet another U.S. Pat. No. 5,147,066 was issued to Donna Snider on Sep. 15, 1992. Another was issued to Malcom Betka on May 15, 1990 as U.S. Pat. No. 4,925,052 and still yet another was issued on Aug. 6, 1996 to Emanuel P. Morano as U.S. Pat. No. 5,542,670.

Another patent was issued to Randi Bollerup Larson on Dec. 30, 1997 as U.S. Pat. No.5,702,020. Yet another U.S. Pat. No. 5,988,425 was issued to Gregory Yehl on Nov. 23, 1999. Another was issued to Mandy Nicola Haberman on Aug. 15, 2000 as U.S. Pat. No. 6,102,245.

U.S. Pat. No. 3,938,695

Inventor: Stanly Ruff

Issued: Feb. 17, 1996

A closure lid for capping the open top of a container. The container is of a type adapted to receive a potable liquid, usually one which is dispensed within a relatively close distance of the point at which it will be imbibed. Such containers with the closure lids emplaced thereon are used for "carry-out" services, as from a luncheonette, or for "carry-about" services, as from an on-the-premises beverage source such as a coffee brewer, a milk container, a carbonated or non-carbonated liquid vessel or a supply of hot water for tea or chocolate. It is customary to cap such containers with closure lids for carry-out purposes and to remove the lids when the potable is to be consumed; indeed it is quite usual to supply lids with the containers—although not attached—when the containers are sold to carry-out stores and to on-the-premises facilities where there are a large number of persons. The present invention provides a unique closure lid which when once in place is not intended to be removed but which is of such construction that a person can drink a potable through it from the capped container without experiencing any inconvenience and is such that it will minimize, and, indeed, almost eliminate, accidental spilling of the potable that heretofore has occurred when an uncapped container is jogged, shaken, or moved unevenly so as to cause spillage of its contents when a slosh wave overrides the rim of the container.

U.S. Pat. No. 4,121,731

Inventor: Scott Okerstrum

Oct. 24, 1978

A top enclosure for drinking is disclosed. The enclosure enables young children to drink from the drinking vessel only when handles on opposing sides of the vessel are depressed. If only one handle is depressed, such as if the vessel drops on the floor and rolls over on one handle, then the top enclosure remains closed and fluids cannot run out of the vessel.

U.S. Pat. No. 4,158,902

Inventor: Milton P. Chernack

Issued: Jun. 26, 1979

An improved integral snap action hinge comprises first and second main parts joined together by a plurality of hinge straps each of which includes a flexible intermediate portion which portions are aligned to define a hinge line which accommodates opening and closing of the hinge. Improved hinge also includes first and second hinge members, at least one of which is comprised of a flexible, resilient material. The first hinge member extends upward from the first main part between two of the hinge straps. The second hinge member extends upward from the second main part between the same two hinge straps, and confronts the first hinge member when the hinge is in the open position. The hinge members are so spaced that when the hinge is moved to the closed position the terminus of the first hinge member engages and slides along the confronting surface of the second hinge member, the sliding movement being accommodated by the flexing of the at least one flexible, resilient hinge member until the first hinge member is moved through a position substantially normal to the second hinge member whereupon the resiliency of the at least one hinge member acts to snap the hinge to the closed position.

U.S. Pat. No. 4,358,032

Inventor: Sidney M. Libit

Issued: Nov. 9, 1982

A container closure such as a bottle top or the like is provided having a base portion for assembly onto the container forming a top to the container, the base portion having an orifice therethrough set in a generally planer top surface. A top member lies atop the planer surface and has a hinge defining the top member into two portions, one of which has structure for affixing it in face to face relationship with the planer surface on top of the base. The other portion is movable about the hinge from an orifice closing position atop the planer surface to an orifice open position extending at an angle to the planer surface. A flexible tongue extends into the area of the hinge and is capable of undergoing a snap movement from one side to the other of a raised rib in the planer surface to hold the second portion of the top in the orifice open position at an angle to the planer surface. The second portion of the top may be equipped with a stopper insertable into the orifice.

U.S. Pat. No. 4,669,622

Inventor: Robert A. Bennit

Issued: Jun. 2, 1987

A hollow vertical cylinder is open at its lower end. A deck having an open communicating with the interior of the cylinder seals the upper end of the cylinder. A cap for the upper end has essentially the same shape and size as the top end. The cap has a first relatively small section and a second relatively large section. The first section is secured along a portion of its periphery to a corresponding portion of the upper end periphery by an integral living hinge. The two sections have adjacent edges disposed along a curved line which extends across the deck, these edges being secured to each other at opposite ends of the line and being otherwise unsecured to each other. The secured edges at each end of the line each constitute a separate integral living hinge. The first section is secured to the top end in a region spaced from both hinges. A prong is secured to the second section and is insertable into and removable out of the opening in the deck.

U.S. Pat. No. 4,925,052

Inventor: Malcolm Betka

Issued: May 15, 1990

A drinking vessel has a cylindrical body (1) forming the main receptacle, and a lid (2) with a snap fit over the rim of the body. The lid has a mouthpiece (6) diametrically opposed to a vent (8) and when turned to one position both are blocked. But when turned to another position, both are opened to the interior of the body (1) by ducts (11) in an inner flange (10) of the lid registering with recesses (5) in the rim of the body.

U.S. Pat. No. 5,147,066

Inventor: Donna Snider

Issued: Sep. 15, 1992

A child's or infant's drinking cup assembly having a cup portion and a lid portion and having means for engaging the portions with each other. The cup portion has a cup cavity and means for engaging said lid portion. The lid portion has a spout and a spout chamber with access holes for sipping from the fluidic contents of the cup when the lid portion is engaged to the cup portion. Lock mechanisms are provided on an upper cylindrical surface of the lid portion for the purpose of engaging stops on an annular surface of the cup portion. When the lid portion is engaged and lockingly fitted to the cup portion, the lock mechanisms maintain the lid portion in engagement with the cup portion and prevent removal of the lid portion by a baby or child.

U.S. Pat. No. 5,542,670

Inventor: Emmanuel P. Morano

Issued: Aug. 6, 1996

A drinking cup has a cover which is formed with a drinking spout at one side and a vent at the other. Elements extend down from under the spout and the vent. A flow control element is provided and made of elastomeric material having a pair of spaced cavities on one side, each cavity having a floor at the bottom thereof. The cavities receive in frictional engagement respectively the lower ends of the elements. This engagement supports the flow control element with the floor of each cavity in sealed relation to its element. Each floor has a passage which is normally closed but opens on the occurrence of a pressure differential on opposite sides of the floor.

U.S. Pat. No. 5,702,020

Inventor: Randi Bollerup Larson

Issued: Dec. 30, 1997

A drinking mug for small children, handicapped and hospital patients, comprising a cup, a lid and a suction tube, is configured in an airtight manner so that only access to the inside of the mug is through the suction tube. Tightness is achieved by disposing the suction tube on the inside of the lid on a drinking spout and by providing a sealing ring in the joint between the lid and the cup. Due to the airtight construction, when liquid is sucked up an under pressure is created inside the mug which subsequently empties the suction tube of liquid. Correspondingly, an attempt by the liquid to run out through the suction tube when the mug is tipped over is counteracted by the siphon effect that results from the airtight construction.

U.S. Pat. No. 5,988,425

Inventor: Gregory Yehl

Issued: Nov. 23, 1999

A sipper cup including a cup assembly having a plurality of threaded grooves formed adjacent a top opening thereof. Further provided is a cap assembly having a spout integrally formed on an upper surface thereof. The cap assembly is equipped with a plurality of threaded grooves for allowing the screwable coupling of the cap assembly with the cup assembly. Such threaded grooves of the cap assembly and the cup assembly are adapted to allow air to pass therethrough. Also included is an elastomeric insert including a spout valve for allowing fluid to exit the spout of the cap assembly only upon the application of suction. In use, air is allowed to enter the cup through the threaded grooves thus compensating for the vacuum formed in the cup assembly upon the exiting of fluid from the spout.

U.S. Pat. No. 6,102,245

Inventor: Mandy Nicola Haberman

Issued: Aug. 15, 2000

A drinking vessel suitable for use as a trainer cup or the like comprises an open-mouthed generally cup-shaped container (2) and a lid (5) for the open mouth of the container. The lid has a mouthpiece (7) associated with it. Valve means (18) are provided to prevent flow of liquid from the interior of the container through the mouthpiece unless a predetermined level of suction is applied to the mouthpiece. Suction alone may be sufficient to withdraw liquid from the trainer cup.

While these sipper cups may be suitable for the purposes for which they were designed, they would not be as suitable for the purposes of the present invention, as hereinafter described.

SUMMARY OF THE PRESENT INVENTION

The present invention is a sipper cup for children composed of a disposable material with a molded hinge that connects the container body and cling lid of the present invention. The hinge serves the user by providing easy opening and closing of the cup, for filling or refilling purposes. The cling lid prevents the beverage contained therein from easily spilling and is outfitted with a sipping tip with aperture therein. The cling lid attaches to the container body via a locking flange and locking recessed channel that fit into and mate with one another. The sipping tip minimizes the amount of liquid spilled if spilling conditions such as knocking over or dropping the cup occur, making this device ideal for children. An alternative embodiment discloses a non-slip insulating sleeve for placement around the container body.

A primary object of the present invention is to provide a molded hinge to connect the container body to the cling lid.

Another object of the present invention is to provide a sipping tip with an outlet to minimize spilling of the beverage contained.

Yet another object of the present invention is to provide a non slip insulating sleeve to restrict heat to a users hand from a hot beverage.

Still yet another object of the present invention is to provide a sipping cup that easily stacks into one another.

Yet another object of the present invention is to provide a sipper cup comprised of disposable material.

Still yet another object of the present invention is to provide a sipper cup with a cling lid that clings to the container body.

Additional objects of the present invention will appear as the description proceeds.

The present invention overcomes the shortcomings of the prior art by providing a disposable sipper cup with a molded hinge, insulating sleeve, cling lid and sipper tip that easily stacks into one another for easy storage and packaging.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
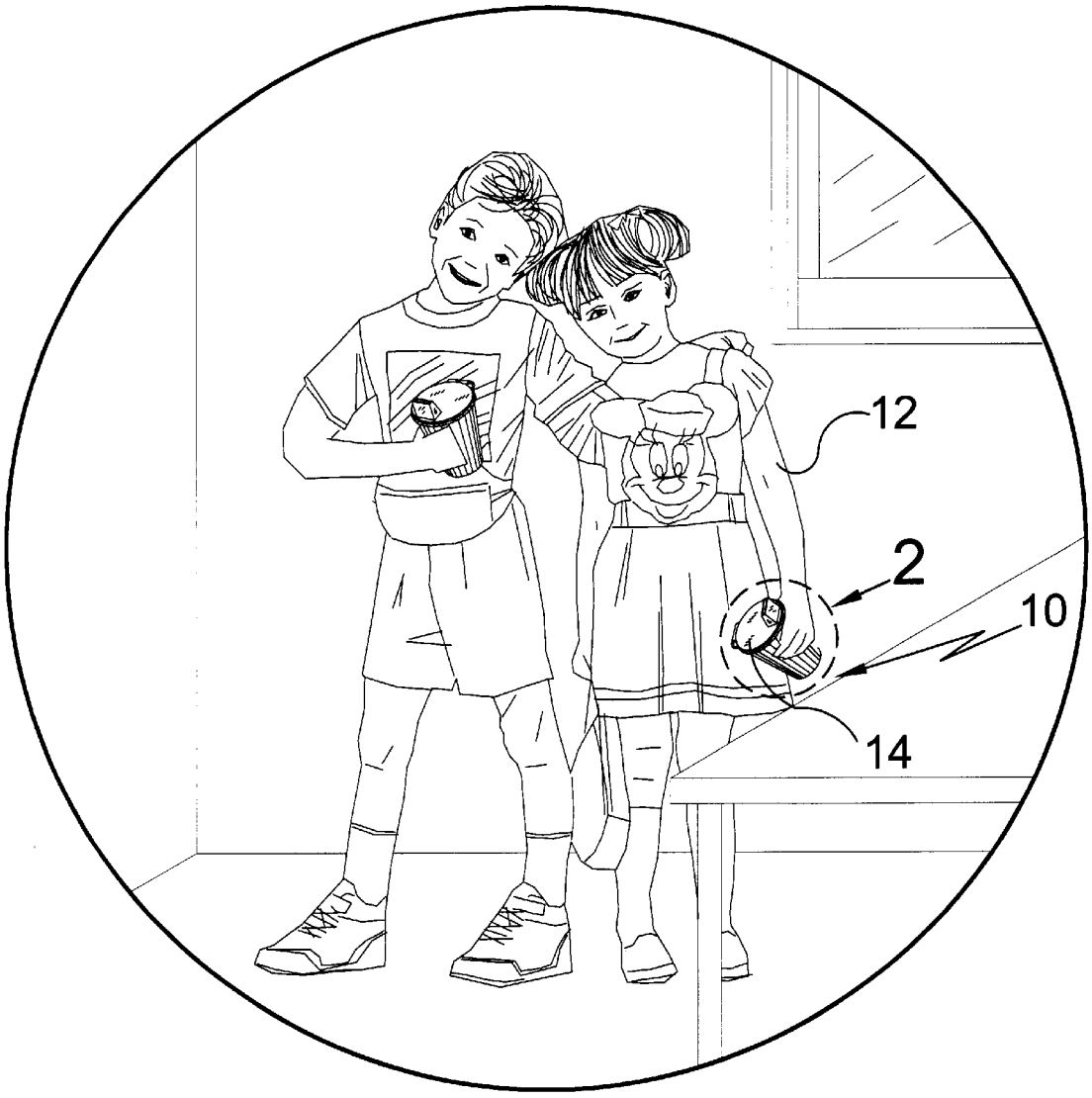
FIG. 1 is a perspective view of the present invention in use.

With regard to reference numerals used, the following numbering is used throughout the drawings.

| | |
|---|---|
| 10 | present invention |
| 12 | children |
| 14 | cling lid |
| 16 | container body |
| 18 | molded hinge |
| 20 | sipping tip |
| 22 | locking flange |
| 24 | locking recessed channel |
| 26 | aperture |
| 28 | arrow |
| 30 | beverage container |
| 32 | sleeve |

DESCRIPTION OF THE PREFERRED EMBODIMENT(S)

The following discussion describes in detail one embodiment of the invention and several variations of that embodiment. This discussion should not be construed, however, as limiting the invention to those particular embodiments. Practitioners skilled in the art will recognize numerous other embodiments as well. For definition of the complete scope of the invention, the reader is directed to appended claims.

Turning to FIG. 1, shown therein is a perspective view of the present invention 10 showing children 12 holding the device at different angles without spilling the beverage contained therein due to the devices cling lid 14.

Figure 2:
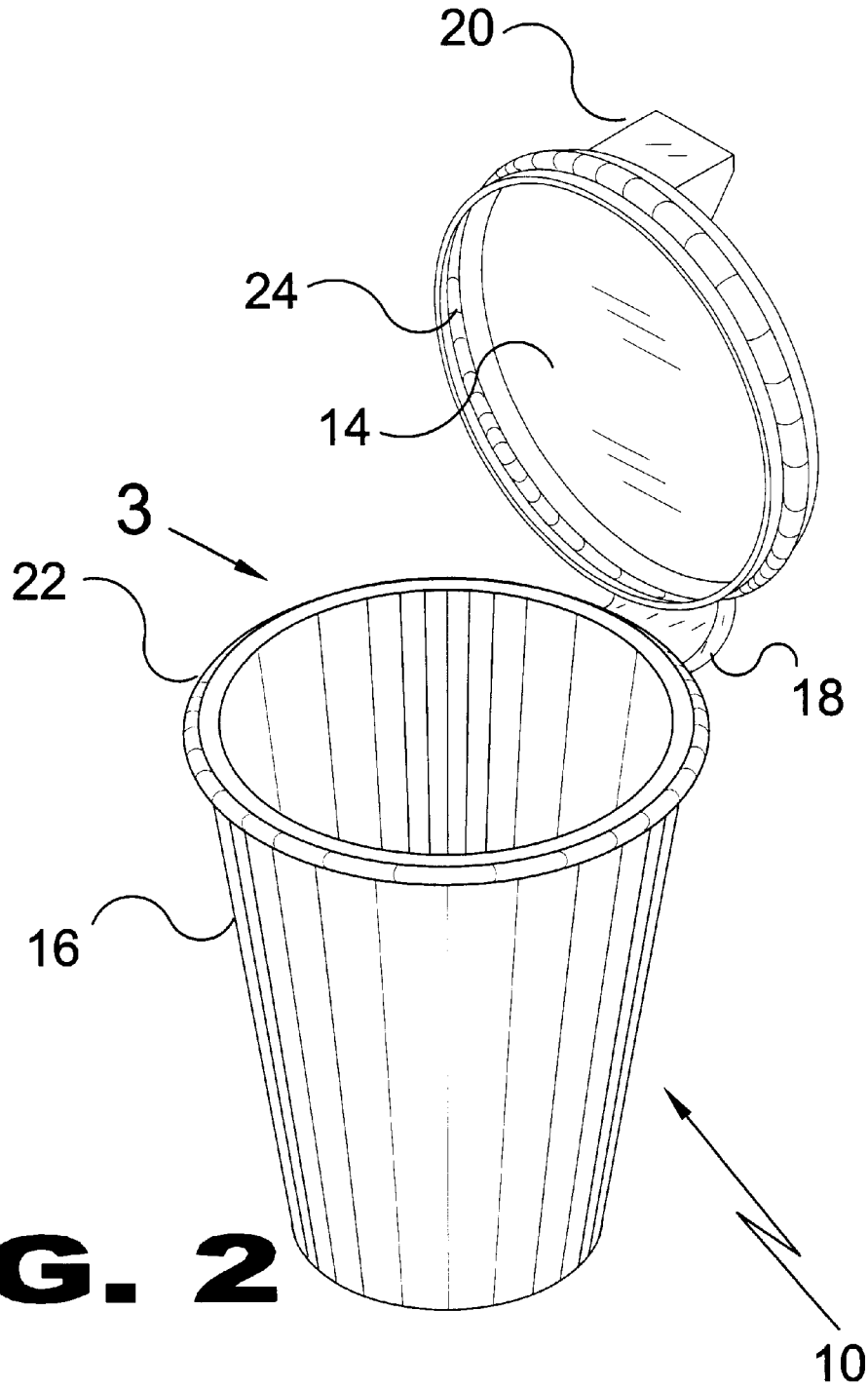
FIG. 2 is an isometric view of the present invention.

Turning to FIG. 2, shown therein is an isometric view of the present invention showing the device 10 having a cling lid 14 that may be opened to fill the container body 16 with a desired beverage. The present invention 10 is a sipper cup for children composed of a disposable material with a molded live hinge 18 that connects the container body 16 and cling lid 14 of the present invention. The hinge 18 serves the user by providing easy opening and closing of the cup 16, for filling or refilling purposes. The cling lid 14 prevents the beverage contained from easily spilling and is outfitted with a sipping tip 20. The cling lid 14 attaches to the container body 16 via a locking flange 22 and locking recessed channel 24 that fit into and mate with one another. The sipping tip 20 minimizes the amount of liquid spilled if spilling conditions such as knocking over or dropping the cup 16 occur, making this device ideal for children.

Figure 3:
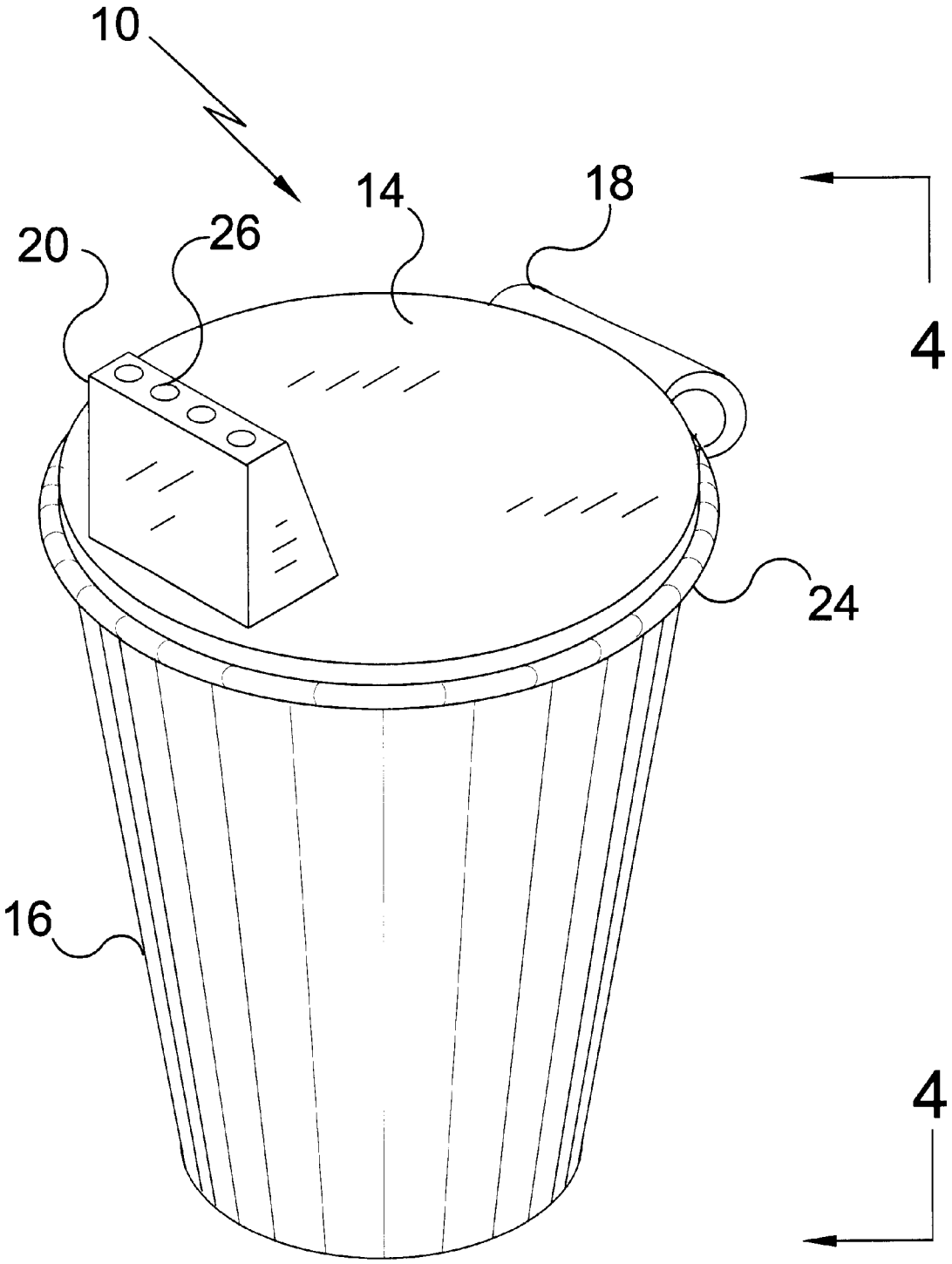
FIG. 3 is an isometric view of the present invention.

Turning to FIG. 3, shown therein is an isometric view of the present invention 10 showing the device having an outlet aperture 26 outfitted on the outwardly extending sipper tip 20 to allow the beverage to flow out of the sipper tip from the container body 16 in a controlled fashion. Other elements previously described are also disclosed.

Figure 4:
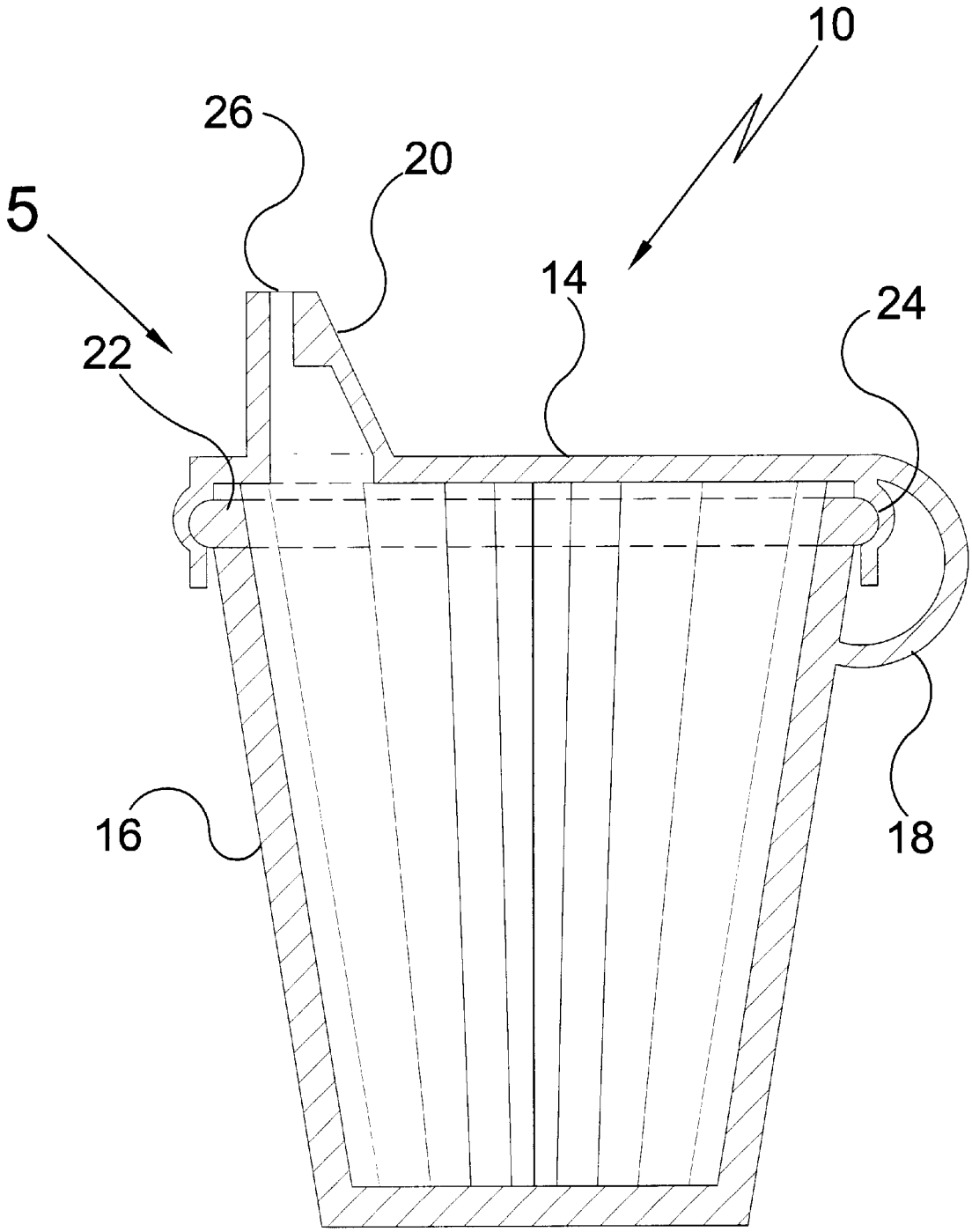
FIG. 4 is a cross section view of the present invention.

Turning to FIG. 4, shown therein is a cross-sectional side view of the present invention 10 showing the device created as one solid molded piece with the molded hinge 18 serving as a connection between the cling lid 14 and container body 16. One end of the hinge 18 is connected to and molded into the lid 14 and a second end of the hinge 18 is connected to and molded into the wall of the container body 16. Lid 14 has a downwardly extending surface about its perimeter wherein the locking recessed channel 24 is disposed on the inside thereof. Other elements previously described are also disclosed.

Figure 5:
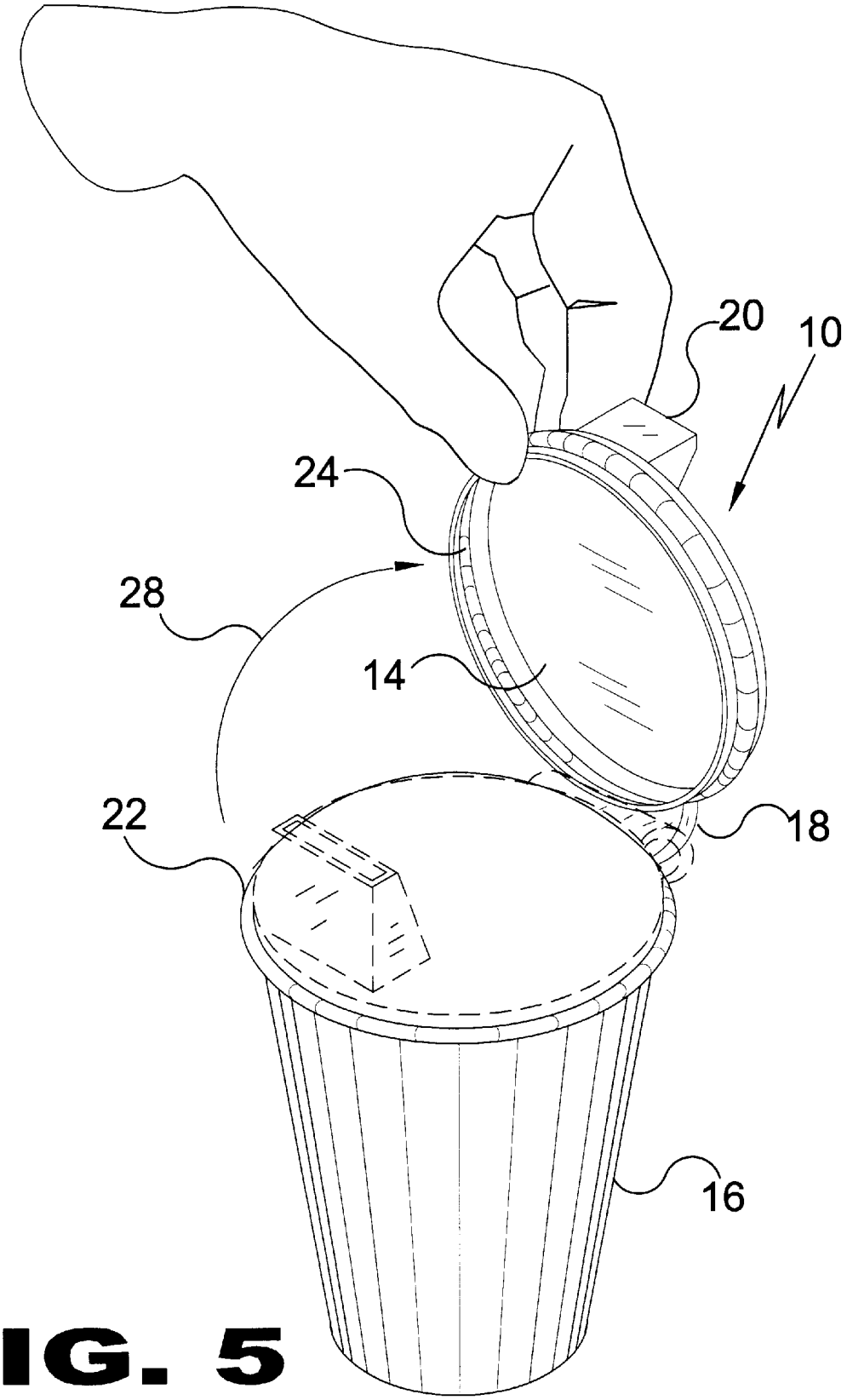
FIG. 5 is an isometric view of the present invention.

Turning to FIG. 5, shown therein is an isometric view of the present invention 10 showing the device making the transition with direction arrow 28 from its closed position to its open position via breaking the seal provided by the locking flange 22 and locking recessed channel 24. Other elements previously described are also disclosed.

Figure 6:
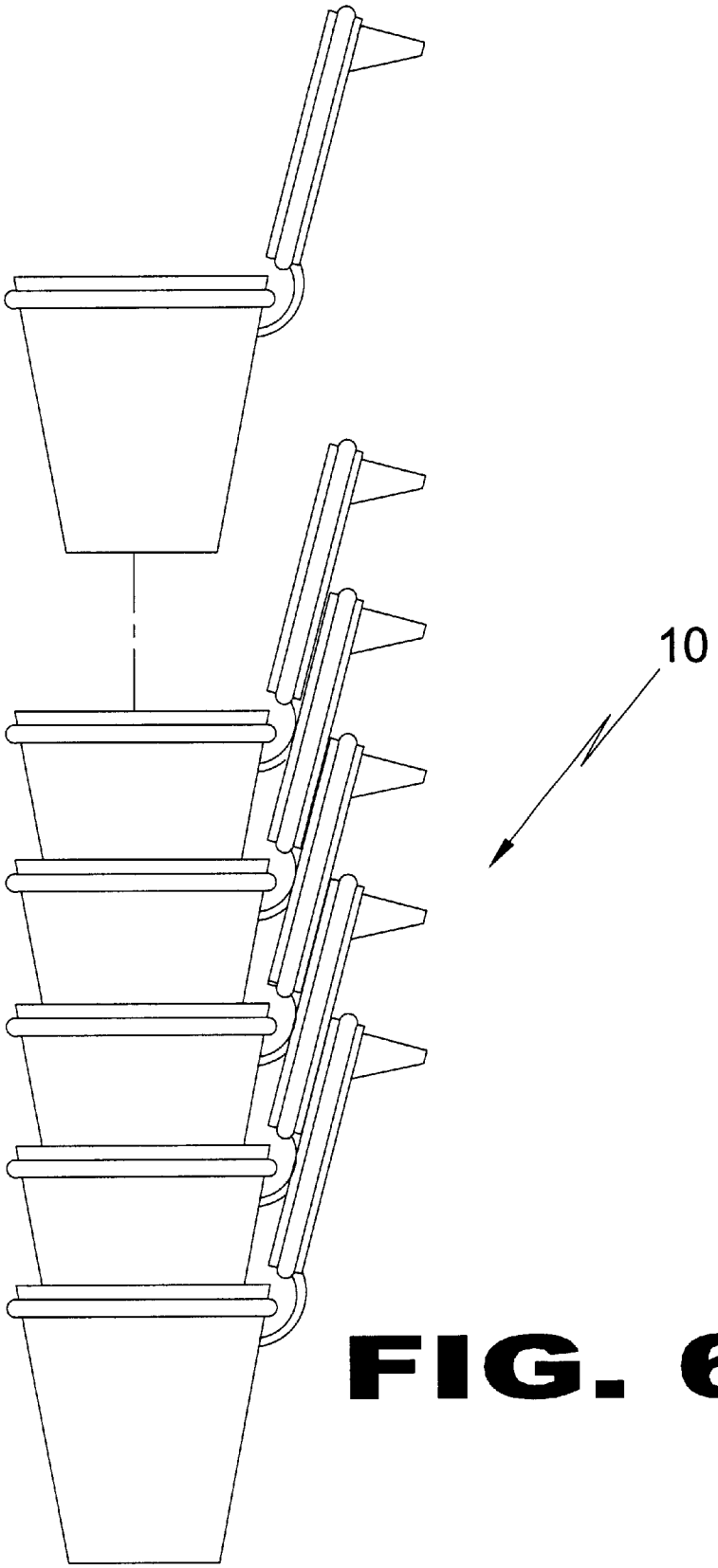
FIG. 6 is a front view of the present invention.

Turning to FIG. 6, shown therein is a front view of the present invention 10 showing the relationship between a plurality of the cups and how the cups can be nested into one another and the lids leaning against each other to provide easy storage.

Figure 7:
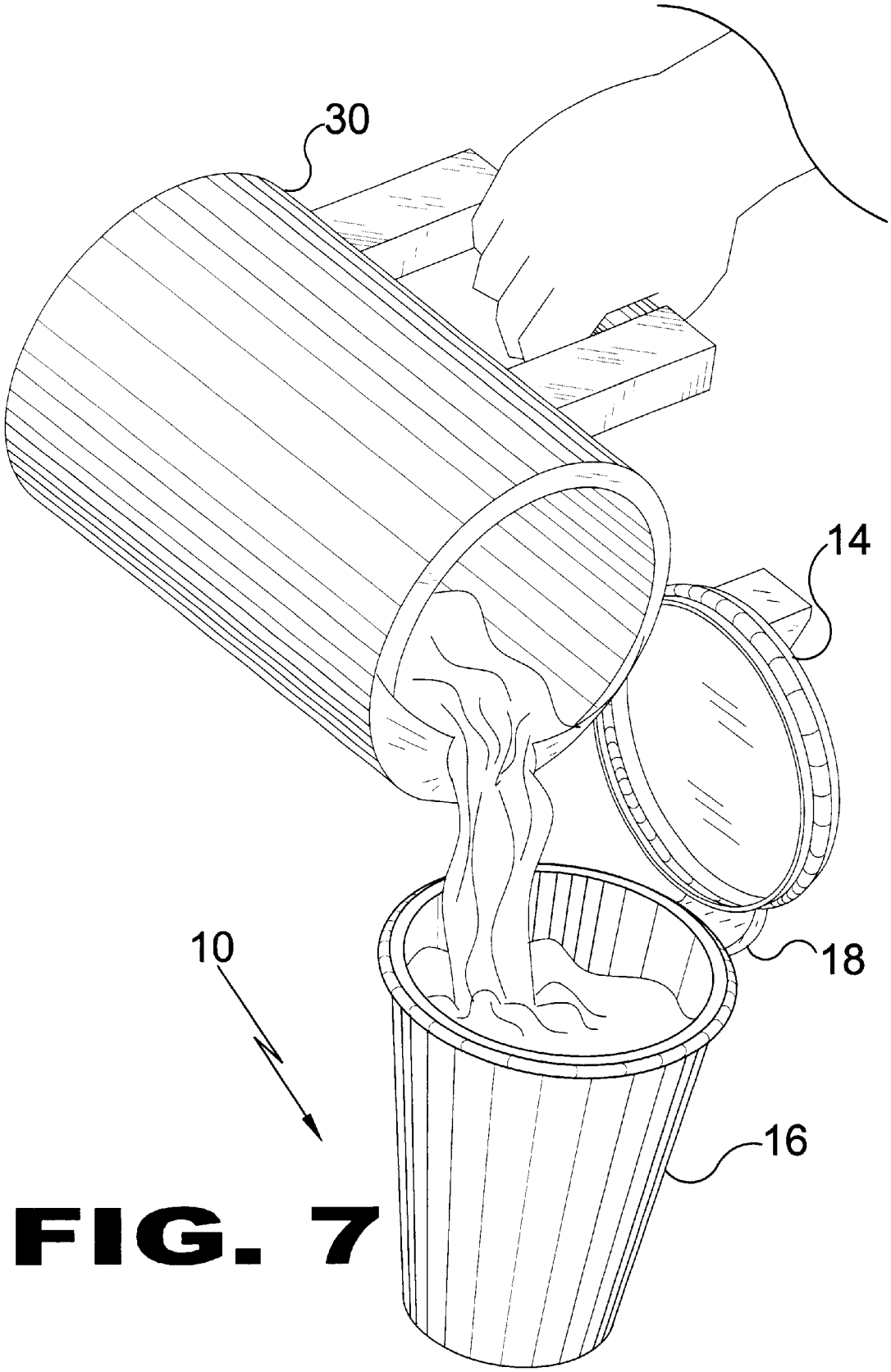
FIG. 7 is an isometric view of the present invention in use.

Turning to FIG. 7, shown therein is an isometric view of the present invention 10 in use showing the present invention with the cling lid 14 in the open position with the users desired beverage being poured from a beverage container 30 into the container body 16 of the device. Other elements previously described are also disclosed.

Figure 8:
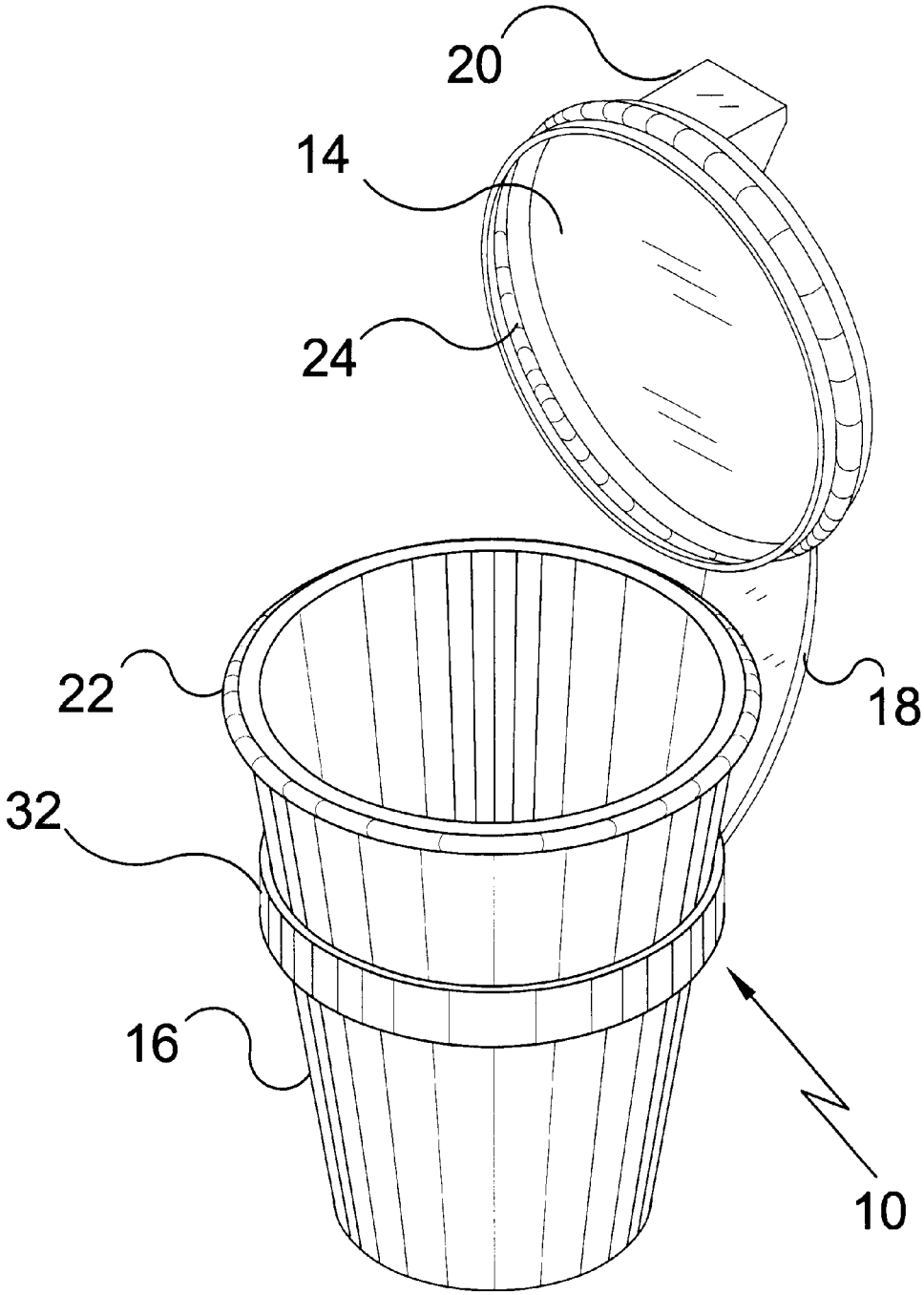
FIG. 8 is an isometric view of the present invention having a non-slip insulated sleeve.

Turning to FIG. 8, shown therein is an isometric view of the present invention 10 having a non slip, ring-like insulating sleeve 32 encircling the cup 16 to provide for easier possession of the cup 16 in ones hand while holding a hot beverage. Other elements previously described are also disclosed.

Figure 9:
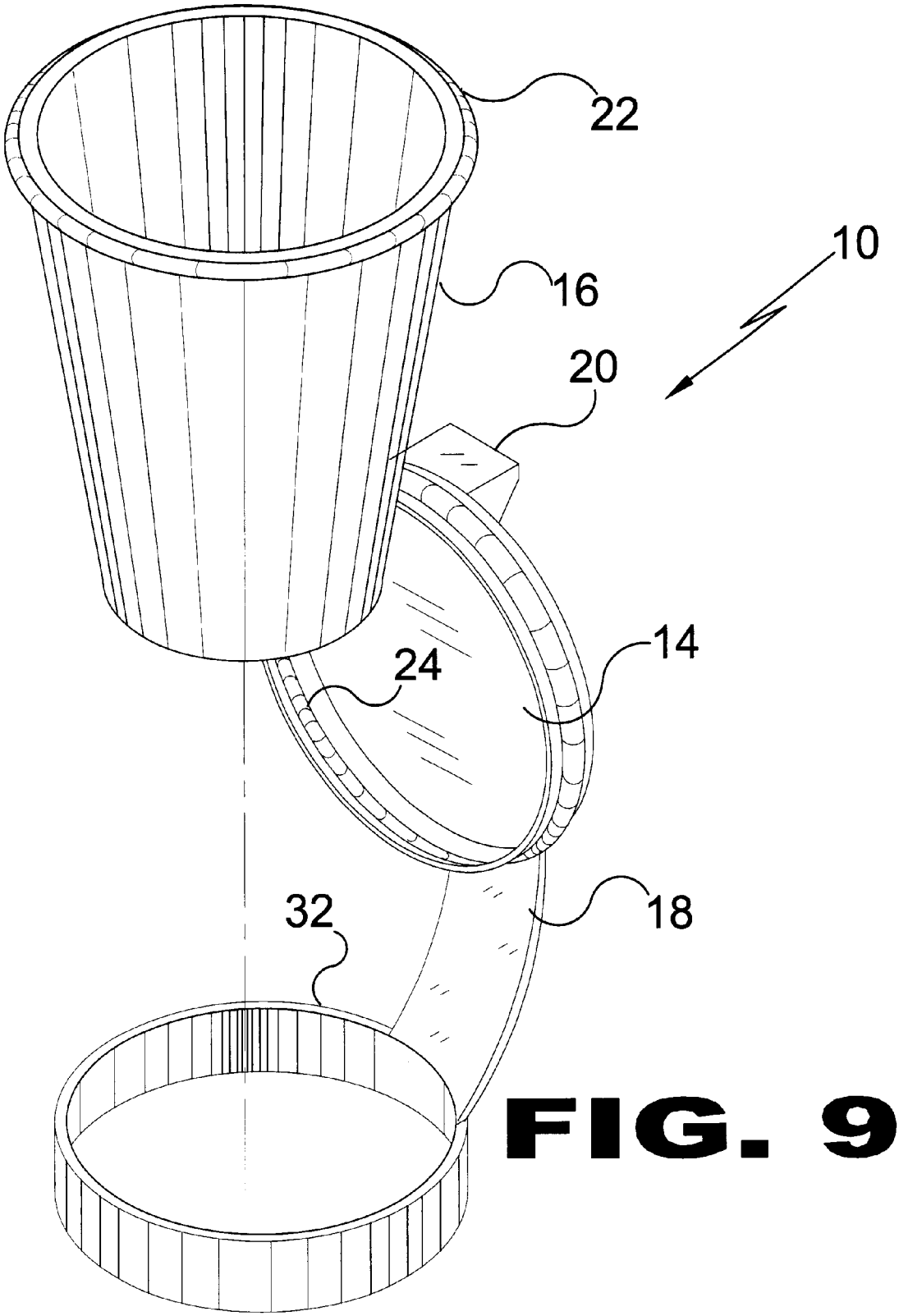
FIG. 9 is an isometric view of the present invention having a non-slip insulated sleeve.

Turning to FIG. 9, shown therein is an isometric view of the present invention 10 having a non slip insulating sleeve 32 placed around the approximate mid-section of container body 16, showing the installation of the non slip insulating sleeve onto the container body 16 by slipping the non slip insulating sleeve around the lower perimeter of the container body. Other elements previously described are also disclosed.

Figure 10:
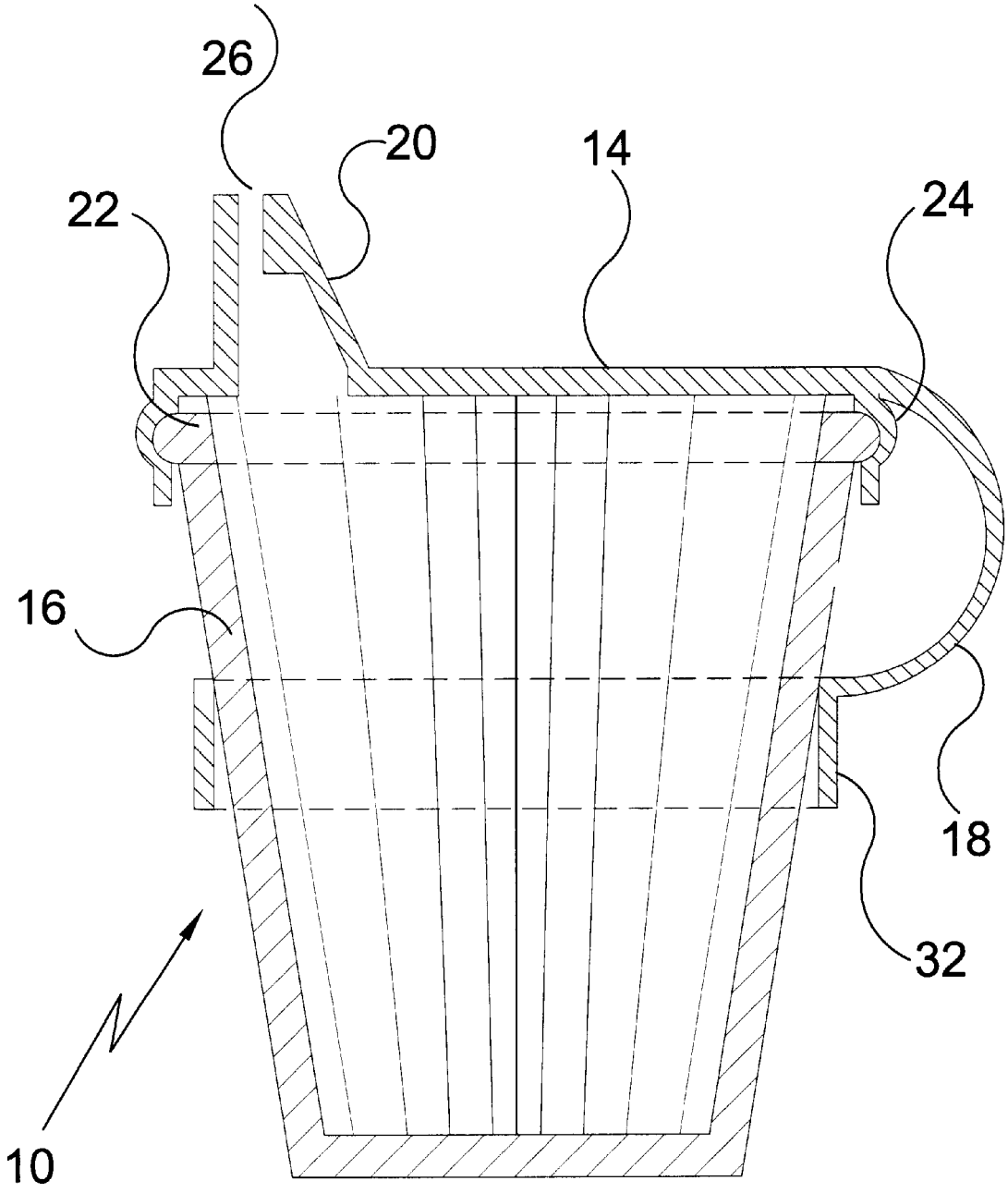
FIG. 10 is a cross section of the present invention having a non-slip insulated sleeve.

Turning to FIG. 10, shown therein is a cross section of the present invention 10 having a non slip insulating sleeve 32, showing the cling lid 14, molded live hinge 18 and non slip insulating sleeve 32 as one piece separate from the container body 16 of the present invention. Other elements previously described are also disclosed.

Figure 11:
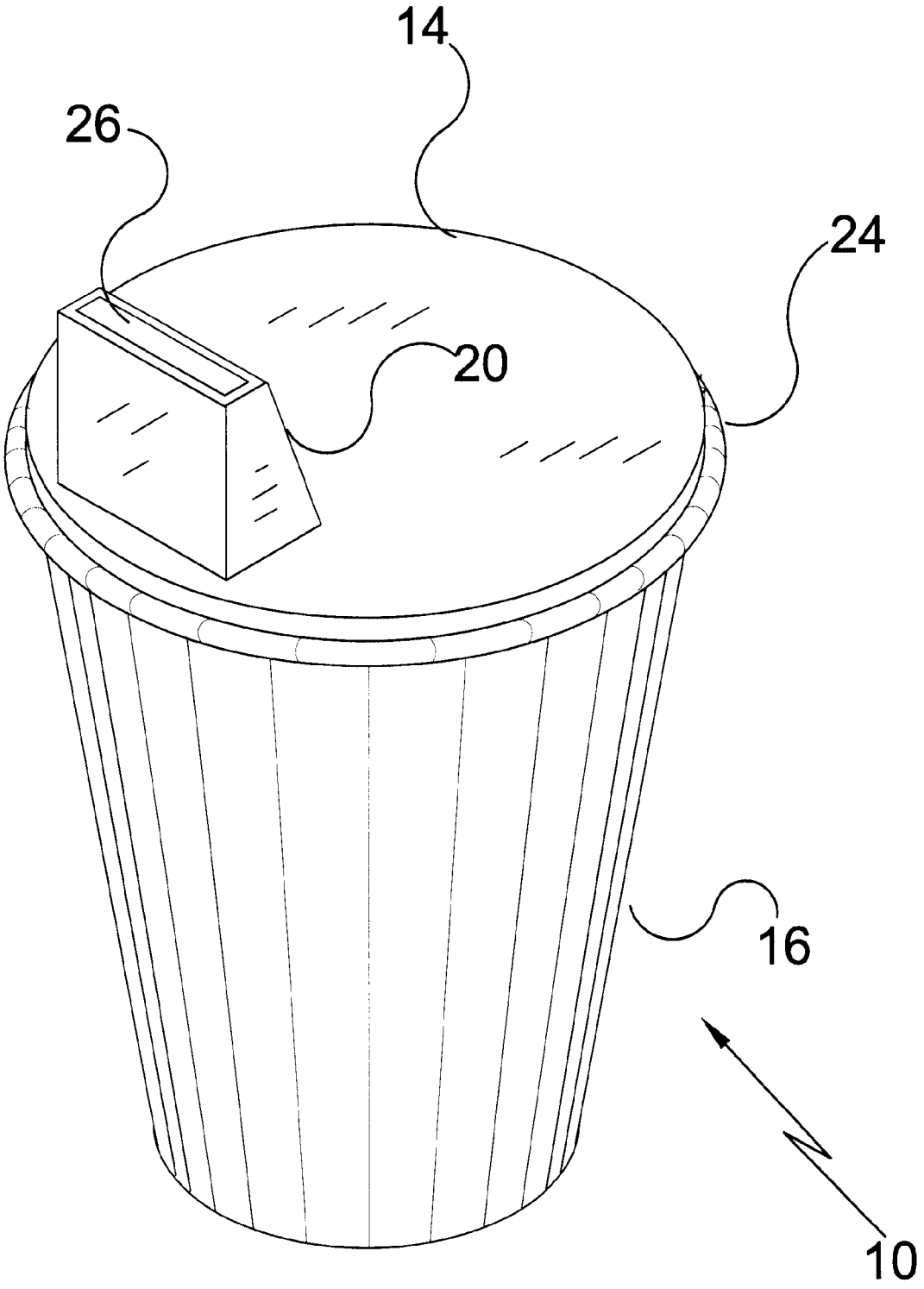
FIG. 11 is an isometric view of the present invention without a hinge.

Turning to FIG. 11, shown therein is an isometric view of the present invention 10 without a hinge, showing the present invention with the absence of a hinge to allow for simplified production.

Figure 12:
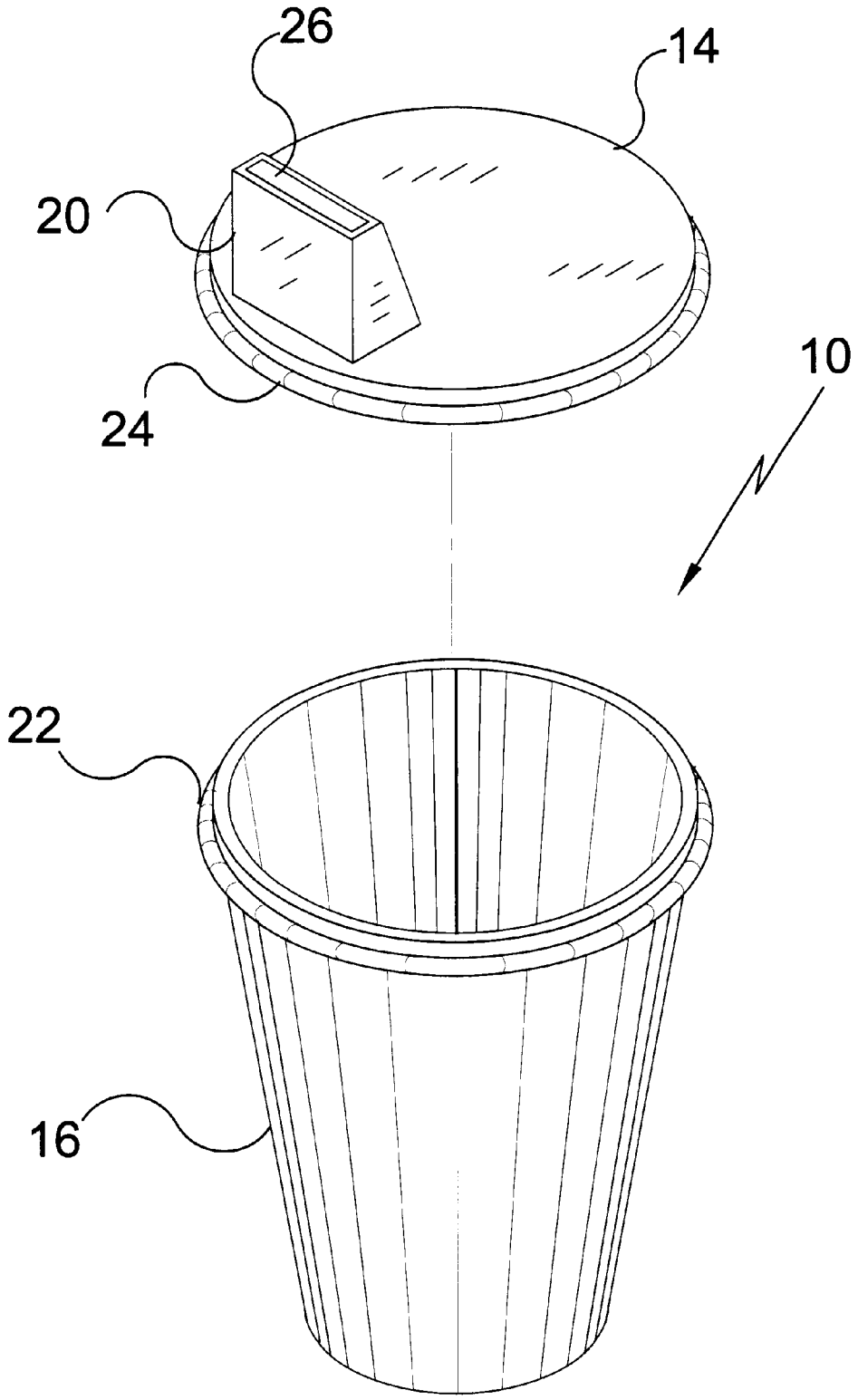
FIG. 12 is an isometric view of the present invention without a hinge.

Turning to FIG. 12, shown therein is an isometric view of the present invention 10 without a hinge, showing the method of securing the cling lid 14 to the container body 16 via the locking recessed channel 24 and locking flange 22 being pressed to mate to and fit into one another. Other elements previously described are also disclosed.

What is claimed to be new and desired to be protected by Letters Patent is set forth in the appended claims.

I claim:

1. An apparatus for a sipping cup for containing fluids, comprising:

a) a cup, said cup having a top end and a bottom end, said cup having an opening on its top end;

b) a rim disposed about said opening of said cup;

c) a lid disposed on said top end of said cup, said lid having a downwardly extending surface disposed about its perimeter, said surface being curved outwardly to form a recess on the inside of said downwardly extending surface thereof;

d) an outwardly extending flange disposed about said rim for mating with said recess so that said lid is secured to said cup;

e) a sipping tip disposed on said lid, said sipping tip extending upwardly from said lid when said lid is secured on to the rim of said cup, said sipping tip having an outlet aperture therein through which fluid can pass;

f) a live hinge for connecting said lid to said cup, said live hinge having a first end and a second end, said first end of said live hinge connected to a wall of said cup and said second end of said live hinge connected to said lid, said second end of said live hinge being molded into a top surface of said lid; and g) said cup having an inwardly sloping wall from said top end to said bottom end so that said cups can be nested inside each other, said wall having a slope such that when a plurality of said cups are stacked with the lids open the lids of the stacked cups lean against each other.

2. The apparatus of claim 1 in which the connection of said second end of said live hinge comprises a removable sleeve molded to said live hinge disposed on and encircling the outer perimeter of said cup, said sleeve adapted for use as an insulated holder of said cup as well for retaining said lid when open.

* * * * *